US007666076B2

(12) United States Patent
Enomoto

(10) Patent No.: US 7,666,076 B2
(45) Date of Patent: Feb. 23, 2010

(54) COIN FEEDING APPARATUS AND METHOD FOR BIASING A RELEASE OF COINS

(75) Inventor: Minoru Enomoto, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 94 days.

(21) Appl. No.: 11/932,840

(22) Filed: Oct. 31, 2007

(65) Prior Publication Data

US 2009/0029638 A1 Jan. 29, 2009

(30) Foreign Application Priority Data

Nov. 1, 2006 (JP) ..... 2006-297283

(51) Int. Cl.
*G07D 1/00* (2006.01)

(52) U.S. Cl. ..... 453/57

(58) Field of Classification Search ..... 453/17, 453/57

See application file for complete search history.

(56) References Cited

U.S. PATENT DOCUMENTS 3,191,739 A * 6/1965 White, Jr. ..... 194/333
3,396,737 A * 8/1968 Picollo ..... 453/5
3,942,544 A * 3/1976 Breitenstein et al. ..... 453/17
4,752,274 A * 6/1988 Abe ..... 453/32
5,046,989 A * 9/1991 Dass ..... 453/17
6,592,446 B1 * 7/2003 Zimmermann ..... 453/56
2006/0019591 A1 * 1/2006 Abe et al. ..... 453/18

FOREIGN PATENT DOCUMENTS

JP 200-298749 10/2000

* cited by examiner

*Primary Examiner*—Patrick Mackey
*Assistant Examiner*—Mark Beauchaine

(57) ABSTRACT

A pressing member having a body member with a first downwardly inclined plate and a second downwardly inclined plate is configured for mounting on a coin feeding apparatus to control the translation of coins on a rotary selector disk as they are released. The coins experience a downward force from the inclined plates to push them against the surface of the rotary disk to ensure that the coins remain within the predetermined translation path for the coins. A blocking plate can be extended upward from the body member adjacent the upstream downwardly extending plate, to prevent a rising of the coins to ensure the coins passes under the canopy of the pressing member across the translation path.

14 Claims, 13 Drawing Sheets

COIN FEEDING APPARATUS AND METHOD FOR BIASING A RELEASE OF COINS

BACKGROUND OF THE INVENTION

1. Field of the Invention

The present invention relates to a coin feeding apparatus for coins that are accommodated in a storage portion, separated by a rotation disk, and fed to a feed-out coin port, and more particularly to a coin feeding apparatus suitable for providing an accurate release of coins fed out along an outer periphery of the rotation disk by way of centrifugal force against a controlled resistance.

2. Description of Related Art

As one example of a conventional technique of a coin feeding apparatus, a rotation disk is provided inside a hopper and coins are scraped out one by one by a claw provided on the rotation disk and moved upward. The coins are received on a coin rail at an exit near a top portion to be guided to a coin mechanism from the exit along the rail, as shown in Japanese Laid-Open Patent Application No. 2000-298749.

In such a conventional technique, a coin can inadvertently drop off the claw due to vibration occurring when coins are supplied and thrown into a hopper while a coin is being subjected to feeding operation to an exit by the rotation disk. Particularly coins having small diameter and a thin thickness can easily drop off. Although such a coin is scraped out and is in the feeding operation, if the coin drops off, the feeding operation is nullified, which undesirably reduces the coin processing efficiency.

Further, at the time of a normal coin feeding by the rotation disk, the coin is pushed out while being moved in the periphery direction on the disk face of the rotation disk, and enters a slit-shaped exit positioned in parallel. The height and width of the exit formed in a slit shape is set such that only a single horizontally-laid coin, positioned on an upper face of a lower rotation circular plate can pass through.

If a coin drops off the disk face of the rotation disk due to vibration or the like, the coin can unintentionally strike the slit-shaped exit obliquely. Then, a coin which obliquely strikes the exit can be pressed with the claw in the feeding operation on its opposite side, and consequently the coin is sandwiched between the exit and the claw to create a locked state.

In such a situation, the rotation disk cannot perform a feeding rotation operation due to the locked coin so that the rotation is stopped. A rotation stop is detected as an operation fault and the entire apparatus is stopped in its operation by a controller and removal of the locked coin is needed to restart the apparatus. Therefore, there is a problem in that a frequent abnormal stop, due to such a cause, also reduces the operation rate of the coin feeding apparatus.

Furthermore, when a coin that is carried near the exit is passed to a coin rail by the rotation disk, the coin can drop off the rail due to an unstable movement caused by vibration of the apparatus itself. The coin can drop off due to irregular motion of the coin itself when stirred and rotated at a fast speed inside the hopper instead of being located on the rail. Also, the coin may not drop off and the coin may be hung up and stopped at the rail.

In this case, when a coin that has passed to the receiving portion is fed out by a feeding wheel, the wheel can press against the coin and cannot rotate so that the apparatus will be stopped in its operation.

There is accordingly, a demand to address such problems as the requirement for increasing the speed of coin movement has increased in this field.

SUMMARY OF THE INVENTION

It is a first object of the present invention to provide a coin feeding apparatus that is capable of efficiently processing a coin by providing apparatus for maintaining and carrying a coin in a more stable controlled state when the coin is being fed by a high speed rotation disk.

It is a second object to provide a coin feeding apparatus in which the apparatus for stably carrying a coin can be achieved with a simple structure and at a low cost.

In order to achieve the above objects, a coin processing apparatus according to a first aspect is configured as follows.

In a coin feeding apparatus configured such that after coins are held and separated into a division recessed portion arranged on an upper face of a rotation disk, the coins are fed out from an opening provided at a predetermined position in the periphery direction of the rotation disk by a coin pushing moving body movably provided within the division recessed portions. When the coins are moved in the periphery direction of the rotation disk by the moving body at the time of the rotation of the rotation disk, a pressing member elastically presses the coins against an upper face of the rotation disk.

In this structure, when the rotation disk rotates, the moving body operates in association therewith to push the coin outward and feed it to the opening at an exit while moving the coin in the periphery direction.

At that time, the coin is further being pressed against the upper face of the rotation disk by a coin pressing portion. The coin can stably lie on the upper face of the rotation disk and is stably put on the moving body. Thus, during the coin feeding operation by the moving body, the coin will not drop off the moving body. The coin is temporarily held by the moving body, accurately fed to the exit opening so that an accelerated coin process can be performed, thereby improving the coin processing rate. It also is possible to provide a coin feeding apparatus with high operation reliability and remarkably less failures.

According to another aspect of the invention, there is provided a coin feeding apparatus wherein the pressing member is provided with a first pressing portion for elastically pressing coins moved from the division recessed portion in the periphery direction of the rotation disk by the moving body against the upper face of the rotation disk, and a second pressing portion for pressing the coins immediately before being passed by the moving body to a coin receiving portion provided near the opening against the upper face of the rotation disk.

With this structure, when the coin in the initial operation of the moving body is pushed outside the division recessed portion, the coin is in a pressed state on the upper face of the rotation disk by the first pressing portion. Thus, since the coin lies on the upper face of the rotation disk in a more stable state, the coin will not drop off the moving body, thereby accurately pushing the coin.

Also when the coin is passed to the coin receiving portion by a further operation of the moving body, the coin is pressed onto the upper face of the disk by the second pressing portion to be stable in its posture so that the coin can be smoothly passed to the coin receiving portion.

Since the coin remains pressed onto the upper face of the rotation disk even after being passed, the coin is stably placed on the coin receiving portion until the feeding rotation wheel reaches an exit position. Therefore, the coins can be accurately fed out one by one by the coin feeding wheel.

According to a third aspect of the present invention, there is provided a coin feeding apparatus comprising a block plate inclined upward relative to the upper face of the rotation disk in the rotation upstream direction of the rotation disk, for preventing the coins moved to the periphery direction of the rotation disk from proceeding toward the inlet of an exit opening, which is provided continuously by the first pressing portion and extends in the diameter direction of the rotation disk.

With this structure, even if the coin moves to strike the exit slot opening in the feeding portion during the coin feeding operation, the movement thereof is stopped by the block plate inclined upward before the opening so that the coin will not strike the inlet of the opening.

Therefore, there can be prevented, an occurrence where the coin will strike the exit opening and be sandwiched between the opening and the moving body to be in a locked state. Accordingly, there are less failures in which the coin will be locked during the feeding operation, thereby providing a coin feeding apparatus with high reliability which can be maintained for a long period of time.

According to a fourth aspect, there is provided a coin feeding apparatus wherein the pressing member is an elastic pressing plate integrally composed of a first elastic pressing piece which is inclined downward and extends so as to be positioned before the coin opening and in contact with the coins on the rotation disk at its tip end and a second elastic pressing piece which is inclined downward and extends so as to be positioned behind the coin opening and in contact with the coins on the rotation disk at its tip end.

With this structure, since the first elastic pressing piece is positioned before the coin opening when the moving body operates to push a coin outside the division recessed portion, the coin can be effectively pushed out. Further, since the second elastic pressing piece is positioned behind the coin opening when the moving body operates to pass the coin to the coin receiving portion the coin can be effectively fed into the coin opening.

Further, an elastic pressing plate in which the first elastic pressing piece and the second elastic pressing piece are integrally formed, before and behind the coin opening is provided so that a coin can be stably fed out with a simple structure. Since the elastic pressing plate can be made of synthetic resin, it can be provided as a simple and inexpensive member, which is practical and easily replaced.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The term "coin" used herein in the specification includes currency coins, tokens, medals and the like, and includes circular ones and polygonal ones in shape.

At first, the structure of the coin feeding apparatus according to the present invention will be described with reference to FIGS. 1 to 11.

The present embodiment is a coin feeding apparatus for use in a coin processing apparatus which can receive 8 different types of coins, such as 2-Euro coin, 1-Euro coin, 50-cent coin, 20-cent coin, 10-cent coin, 5-cent coin, 2-cent coin and 1-cent coin, which are common currency of the European Union, and can store coins of each type, and pay a predetermined number of coins of predetermined types based on payment instruction for example in a vending machine.

Figure 1:
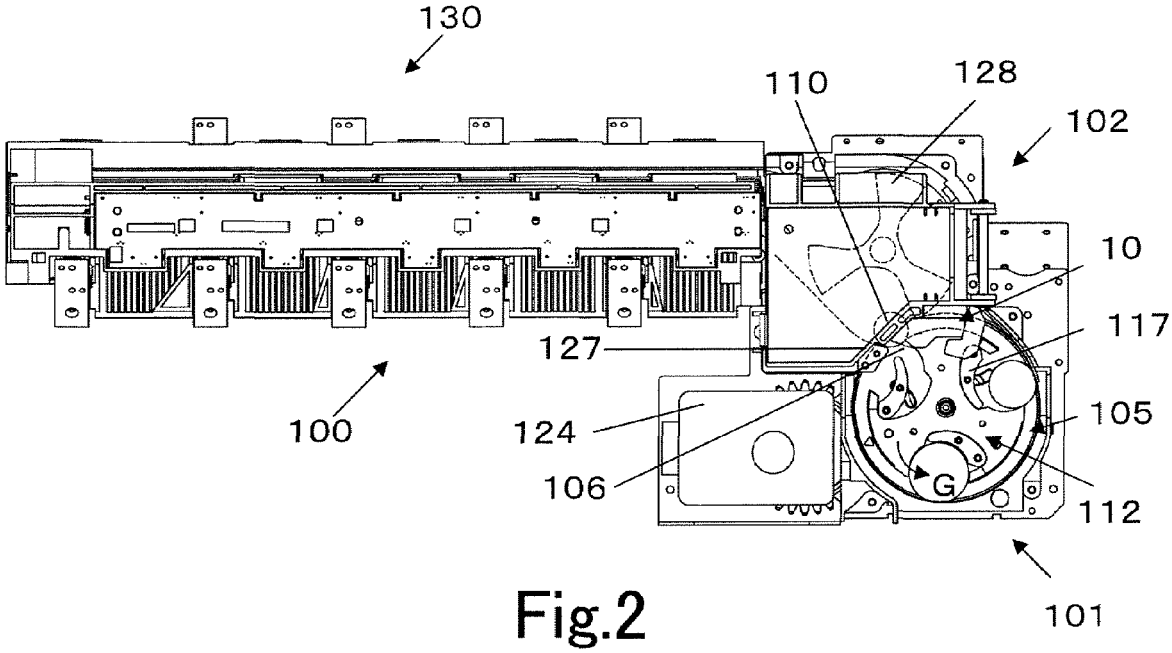
FIG. 1 is a schematic front view of a coin processing apparatus using a coin feeding apparatus according to the embodiment of the present invention.

In FIG. 1, the coin processing apparatus 100 includes a coin feeding apparatus 101, a coin type determining apparatus 102, a coin carrying apparatus 103 and a coin selecting apparatus (not shown) provided inside the coin carrying apparatus 103.

In other words, the coin feeding apparatus 100 is provided with a rotation disk 105 for dividing and feeding coins one by one and the coins are fed to the coin type determining apparatus 102 one by one by a moving body 117 pivotably provided on the rotation disk 105. A coin 110 is fed into the coin type determining apparatus 102 through a coin passing opening 106 provided at the top of the coin feeding apparatus 101.

The present invention is characterized in that the coin 110 is pushed toward an outer periphery direction of the disk as a result of a rotational operation of the rotation disk 105 in the coin feeding apparatus 101 and coins are fed into the coin opening 106 at the top thereof while being moved along the outer periphery of the disk. A pressing member 10 can press a coin 110 against an upper face 105S of the rotation disk 105 so that the coin feeding operation can be stably performed at a high speed.

The pressing member 10 is arranged along the rotation path of the coin rotation disk 105 adjacent the coin opening 106. While the coin 110 is being carried from the coin feeding apparatus 101 to a coin type determining apparatus 102, the coin neither drops off the moving body 117 nor becomes jammed along the moving path, and is accurately fed into the coin opening 106 so that the coins can be efficiently processed. Details thereof will be described subsequently.

After the authenticity and type of coins are determined by a magnetic sensor or the like (not shown since conventional sensors can be used) in the coin type determining apparatus 102, the coins are fed into the carrying apparatus 130 for the next processing step, and the coins are separated based on the type or denomination in the coin selecting apparatus 130 which is configured to open/close predetermined gates to release specific coins while coins are carried along a predetermined path.

Figure 2:
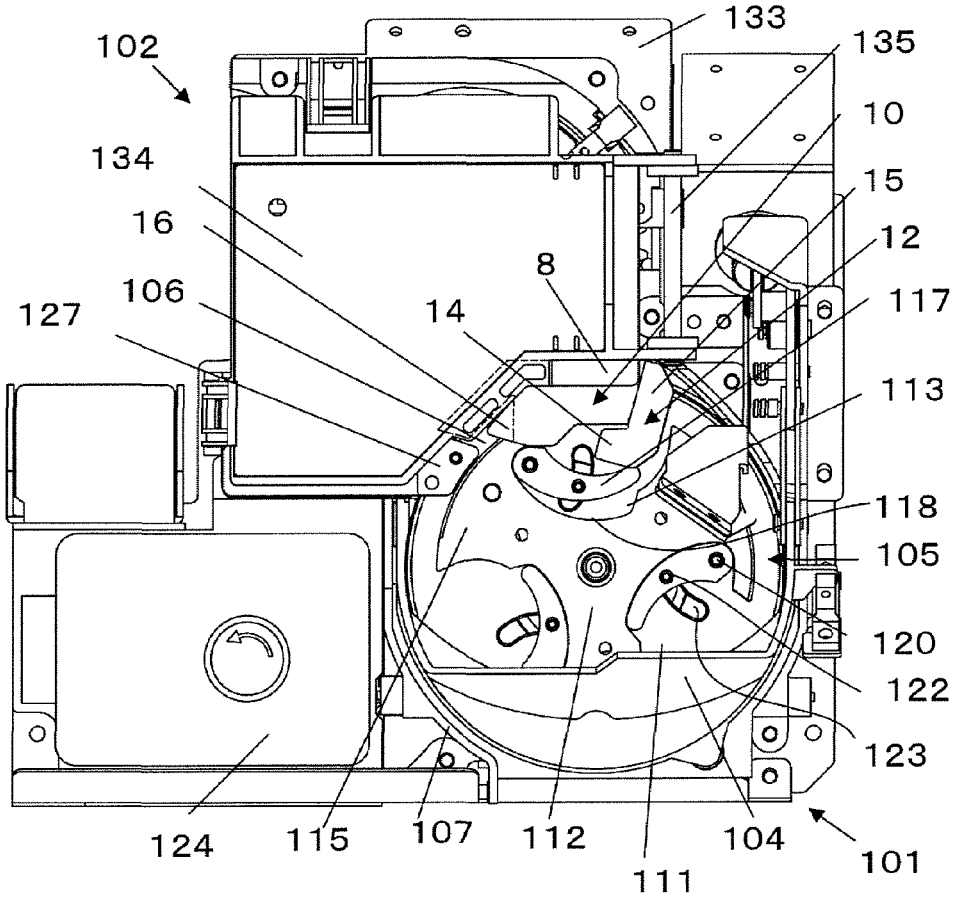
FIG. 2 is a front view of the coin feeding apparatus according to the embodiment of the present invention.

For more detailed description, the coin feeding apparatus 100 includes a rotation disk 105, a storage bowl 104 for storing coins, and a cylinder-shaped storage ring 107 positioned under the storage bowl 104 to surround the rotation disk 105 as shown in FIG. 2. Several different types of coins, thrown from the coin throwing port, are introduced and dropped into the storage portion under the release port of the storage bowl 104 to be stored in an accumulated manner.

The rotation disk 105 has a universal division recessed portion 113 for receiving different denominations of coins one by one, and is obliquely provided at the bottom of the storage ring 107 at a predetermined angle to be rotated at a predetermined speed and in a certain direction, that is counterclockwise as shown by an arrow G in the embodiment of FIG. 1.

The rotation disk 105 is composed of a base rotation circular plate 111 and a pushing disk 12 fixed on the upper face of the rotation circular plate 111 coaxially with the rotation circular plate 111 and made of a Y-shaped plate having three recessed portions at a constant interval on the protrusion 115 so that a space between the protrusions 115 of the pushing disk 112 and the moving body 117 described later form a substantially semicircular division recessed portion 113 at the upper face of the rotation circular plate 111.

Further, the depth of the division recessed portion 113, that is the thickness of the pushing disk 112 is formed to be slightly smaller than the thickness of the thinnest coin among the 8 types of coins.

The plate is not limited to a Y-shape and may be found as a plate in which several protrusions are radially formed. The rotation circular plate 111 and the plate, that is the pushing disk 112, may be integrally shaped by pre-sintered metal or from a wear-resistant resin.

The division recessed portion 113 between the protrusions 115 has a moving body 117 arranged at its one side, which pivotally operates about a pivot shaft 120 to receive and eject coins.

The division recessed portion 113 is formed to be a substantially semicircular division recessed portion on the rotation circular plate 111 by the moving body 117 and the protrusions 115. A slightly concaved recessed portion is formed at the other side of the division recessed portion 113 in the protrusion 115 and a coin extrusive portion 121 for receiving the coin 110 against the recessed portion and carrying the same is formed in the recessed portion. An arcuate receiving portion 118 for receiving the moving body 117 is provided in the division recessed portion 113 in opposite to the coin extrusive portion 121.

Here, the division recessed portion 113 is set in its size such that two coins having the smallest diameter cannot be received side by side and only one coin having the largest diameter can still be received. Thus, two coins having the smallest diameter cannot be received into the division recessed portion 113 in a side by side in the diameter direction of the rotation disk 105.

When the moving body 117 is typically in the rest state near one side of the recessed portion so as to form a fully open position for the division recessed portion 113 and is subsequently moved to a predetermined position through the pivot motion, the moving body 117 thereby feeds the stored coins in the periphery direction of the rotation circular plate 111.

The ejection movement to the predetermined position by the moving body 117 is initiated along the rotation path of the rotation disk 105 slightly downstream of the aforementioned coin passing opening 106 which is formed such that the coin can pass to the coin type determining apparatus 102 at the top of the storage ring 107. When the moving body 117 passes through the opening 106, the moving body 117 is returned and operated to be accommodated in the receiving portion 118 formed at one side of the recessed portion to again receive a stored coin.

The moving body 117 can be moved on a groove cam by utilizing the rotation operation of the rotation circular plate 111. In other words, a pin 122 is fixedly provided at the middle of the moving body 117 and is inserted into an arcuate through hole 123 formed about the pivot shaft 120, where the pin 122 is formed in the rotation circular plate 111 of the rotation disk 105. Further, there may be employed a drive mechanism in which the pin 122 is slidably inserted into a groove cam provided at the lower side of the rotation circular plate 111 (not shown) through a moved body such as a roller.

The rotation disk 105 is rotated by an electric motor 124 (see FIG. 1). The rotation of the electric motor 124 is transmitted to a speed reducing or deceleration gear (not shown) formed at a lower periphery face of the rotation circular plate 111 (not shown) through a decelerator gear or gears and the rotation disk 105 is rotated at a predetermined speed.

A coin feeding wheel 128 is provided at the side of the coin type determining apparatus 102 into which a coin is fed. A coin guide rail 129 is provided inside the coin type determining apparatus 102 in correspondence to the wheel 128.

A part of the coin guide rail 129 near the opening 106 is formed into a knife-shaped coin receiving portion 127 (see FIGS. 5 and 6) for easy reception of the coin 110. The thicknesses of the coin guide rail 129 and coin receiving portion 127 are set to be of sufficient size to accommodate the coins.

Thus, the coins 110, accumulated inside the storage bowl 104, are stirred by the rotation disk 105 having the above structure and the coins 110 are held in the division recessed portion 113 one by one and moved upward, and are pushed out in the periphery direction from the division recessed portion 113 by the moving body 117 when the coin reaches the predetermined position above the rotation center.

The pushed coins 110 are lead to the opening 106 via the coin receiving portion 127. Then, the coins are fed into the coin type determining apparatus 102 while being rotated along the guide rail 129 by a feeding arm 128*a* of the wheel 128 at the side of the coin type determining apparatus 102 which is rotating to face the opening 106, and then the coins are fed into the carrying apparatus 104 and subsequently to a coin type determination.

In this manner, the coin 110 is fed from the opening 106 to a coin passage 130 at the side of the coin type determining apparatus 102 by the rotation disk 105 in the same posture as the obliquely-provided rotation disk 105, and is received by the coin receiving portion 127. The opening 106 is provided at an obliquely-cut portion at the lower right corner of the box-shaped coin type determining apparatus 102 as understood from FIGS. 2 and 11.

For a further description of the coin type determining apparatus 102, the coin type determining apparatus 102 accommodates the wheel 128 in the circular recessed portion 126, and is composed of a plate-shaped fixed substrate 133 below the coin guide rail 129 and coin receiving portion 127 and a main body 134 which is pivoted at an attachment shaft 135 on the right of the fixed substrate 133 in an openable/closable manner, has a box-shaped case and incorporates a coin type determining sensor or the like inside the case, see FIG. 2. Here, part of the periphery of the circular recessed portion 126 formed in the fixed substrate 133 is opened and is communicated with a recessed portion 109 inside the coin feeding apparatus 101 (see FIG. 5).

The inner bottom face of the circular recessed portion 126 is a wheel-arranged base face 126S and the inner bottom face of the recessed portion 109 inside the apparatus is an upper face 105S of the rotation disk. The wheel-arranged base face 126S and the upper face 105S of the rotation disk are continuous in the plane. Thus, the inner bottom face of the circular recessed portion 126 as the coin feeding face and the inner bottom face of the recessed portion 109 inside the apparatus are continuous in a smooth plane so that a coin can be smoothly moved from the coin feeding apparatus 101 to the coin type determining apparatus 102 through the coin opening 106.

Figure 15:
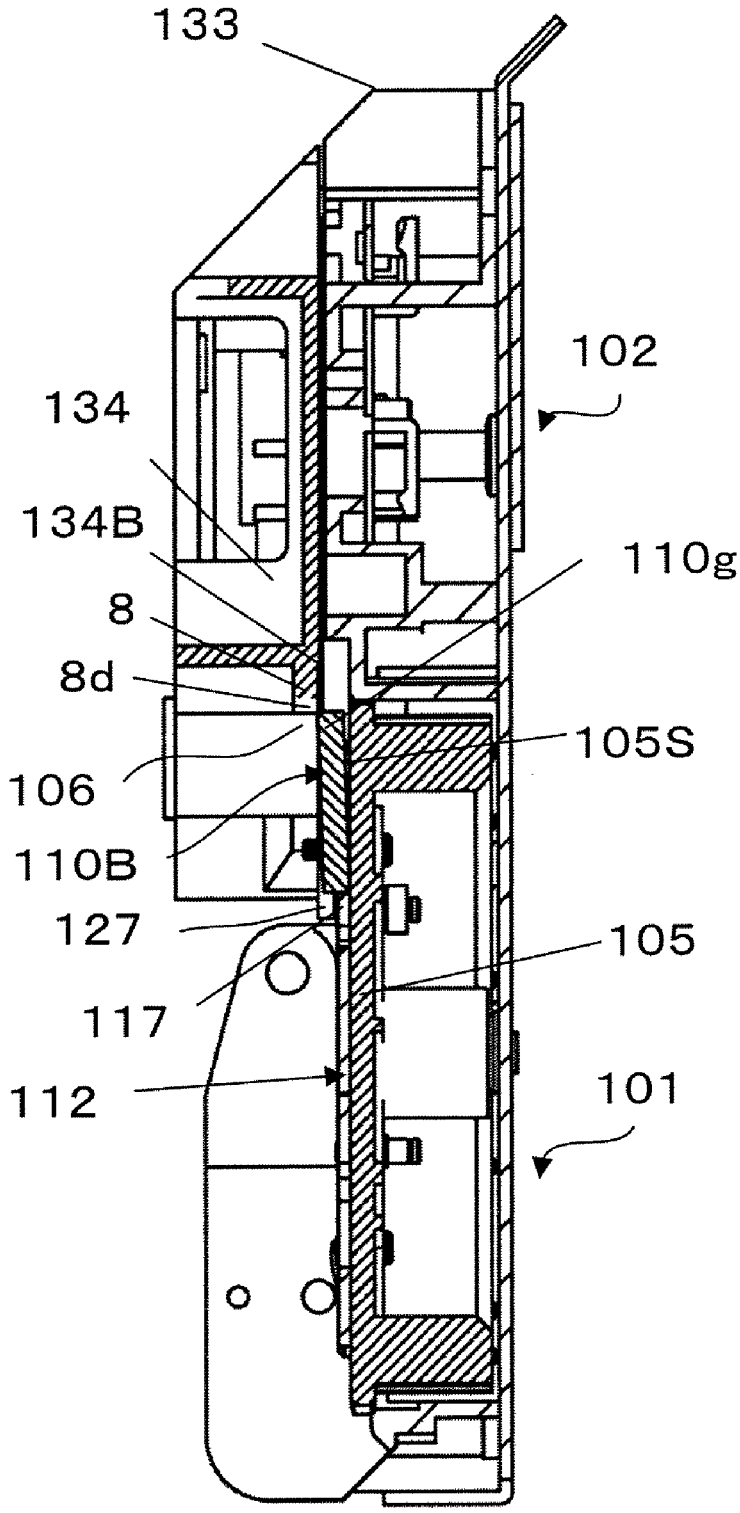
FIG. 15 is a cross-section view taken along the line A-A of FIG. 14.

When the main body 134 of the coin type determining apparatus 102 is closed, as shown in FIG. 15, the rear face 134B of the main body 134 is opposed to the wheel-arranged base face 126S as the inner bottom face of the circular recessed portion 126, and is also opposed to the upper face 105S of the rotation disk as the inner bottom face of the recessed portion 109 inside the apparatus. Thus, the opening 106 is formed among the three members.

The coin opening 106 is in a slit rectangular shape, and the thickness and width thereof is set so that only one coin at a time can pass. Since the coin feeding apparatus copes with several types of coins, the opening 106 is set and formed to have a thickness and width in as much conformity as possible to a coin having the maximum thickness and maximum diameter.

For detailed description, the opening 106 is a rectangular port surrounded by 4 members such as the coin receiving portion 127 for defining the thickness and width of the opening 106 and the right-side protrusion 140 (see FIGS. 6 and 9) at the circular recessed portion opposite thereto in addition to the rear face 134B of the main body, the circular recessed portion 126 and the recessed portion 109 inside the apparatus. The surface of the wheel 128 is covered with the rear face 134B of the closed main body.

Figure 11:
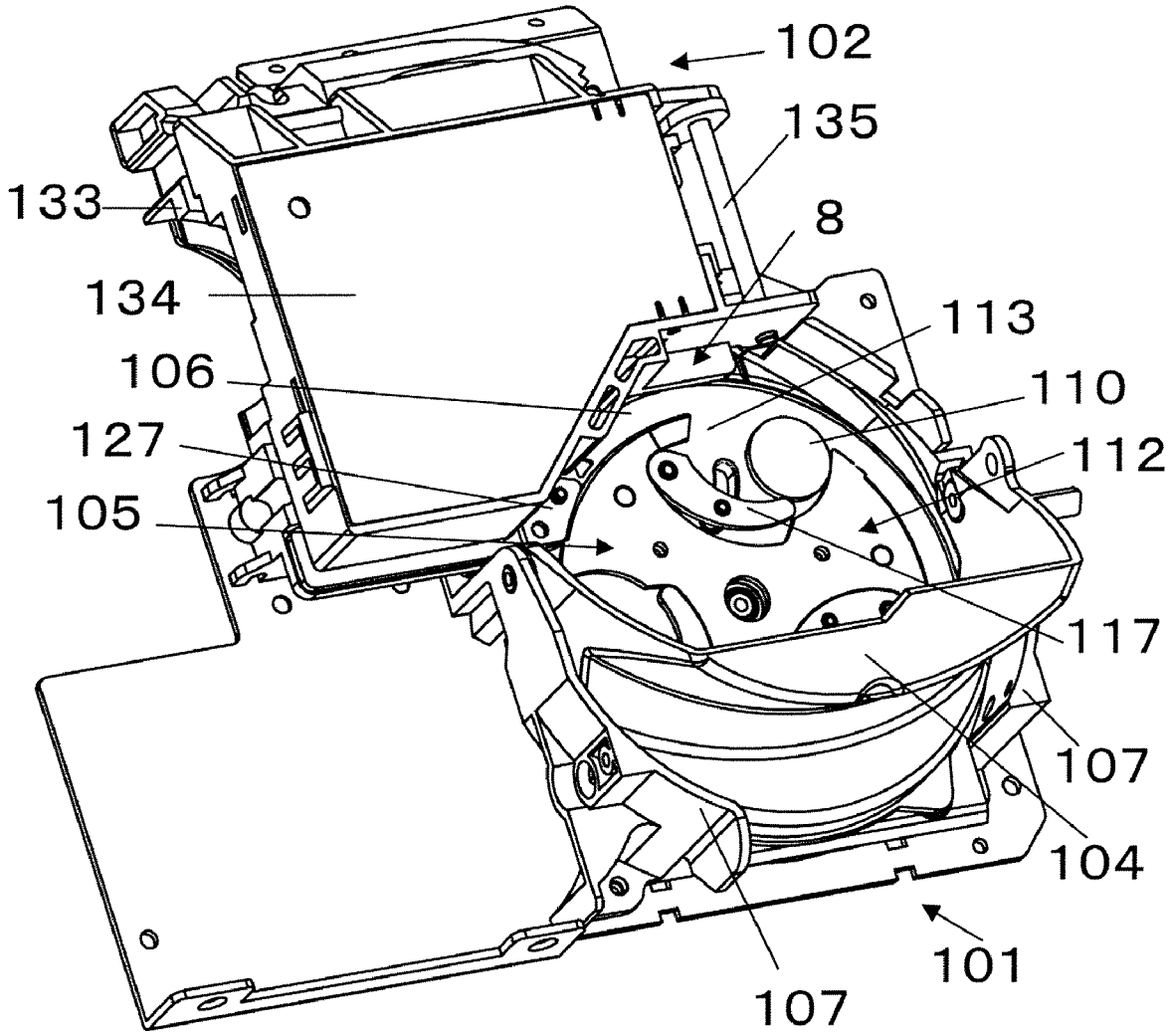
FIG. 11 is a perspective view of the entire appearance showing a schematic structure of the coin feeding apparatus according to the present invention.

At the coin opening 106, an attachment plate 8 of a horizontally-long plate shape, as shown in FIG. 11 is mounted in a canopy shape at the lower end of the main body 134 of the coin type determining apparatus 102. The canopy-shaped attachment plate 8 is positioned opposed to the wheel-arranged base face 126S and the disk face 105S of the rotation disk when the main body 134 is closed, and constitutes part of the opening as an upper wall of the opening 106.

When the rotation disk 105 is rotated, and the coin 110 is pushed outside the division recessed portion 113 by the moving body 117 which pivotally operates in accordance with the rotation, and is fed toward the coin opening 106 while being moved along the inner periphery of the storage bowl 104, the feeding operation may not be normally performed in some cases.

Figure 12:
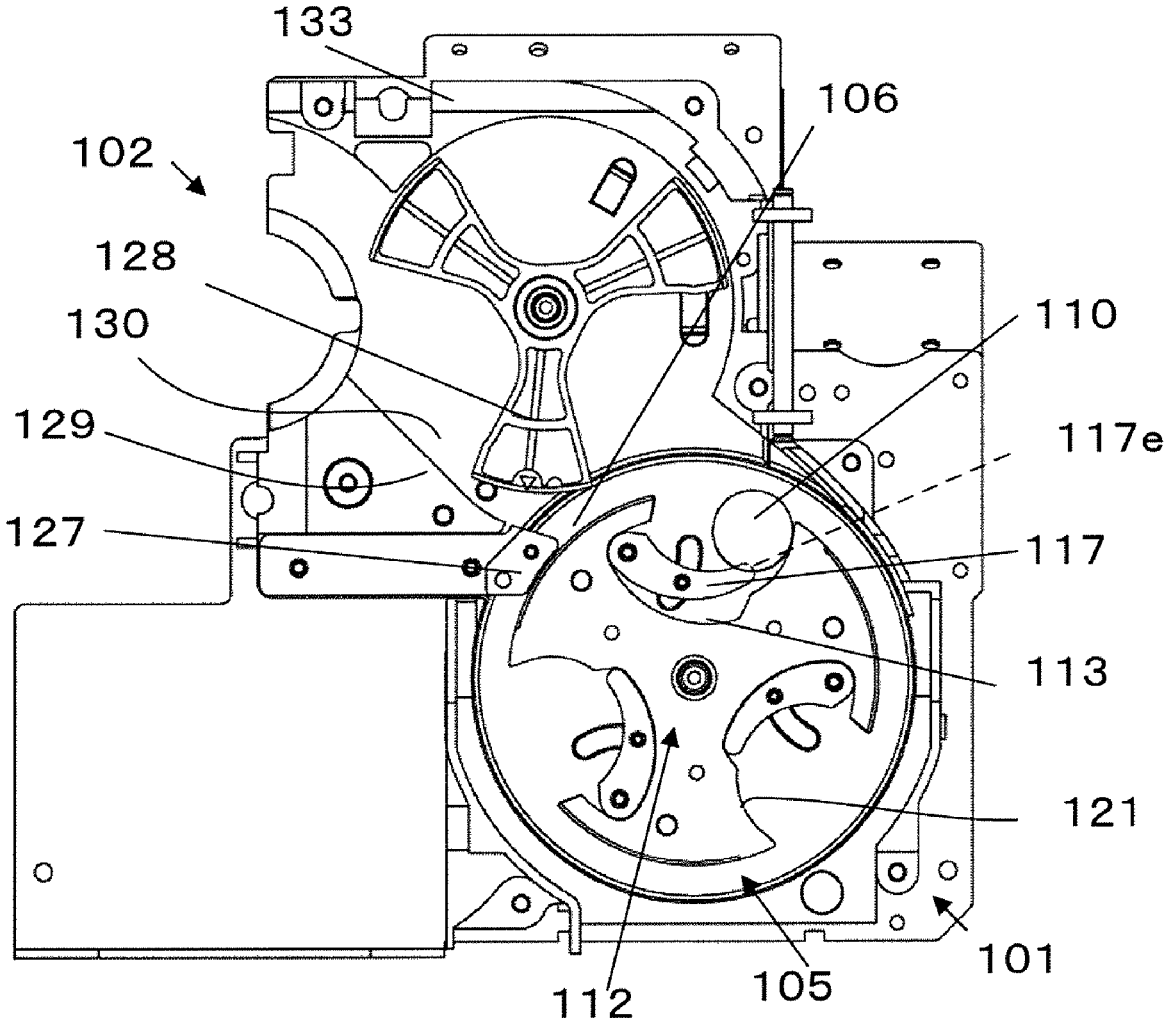
FIG. 12 is a view showing various failure phenomena of coin feeding by an unimproved coin feeding apparatus according to the present invention, which is a front view showing coin drop-off phenomenon.

For example, a phenomenon as shown in FIG. 12 may occur. In other words, when the coin 110 is pushed out from the division recessed portion 113 by the moving body 117, the coin 110 may drop off a tip end 117*e* of the moving body 117 due to the apparatus's vibration or the like. If the coin 110 may drop off when the coin 110 is captured by the moving body 117 and is not smoothly ready to be fed into the opening 106, the coin feeding rate decreases so that the apparatus lacks in its coin processing ability.

Figure 13:
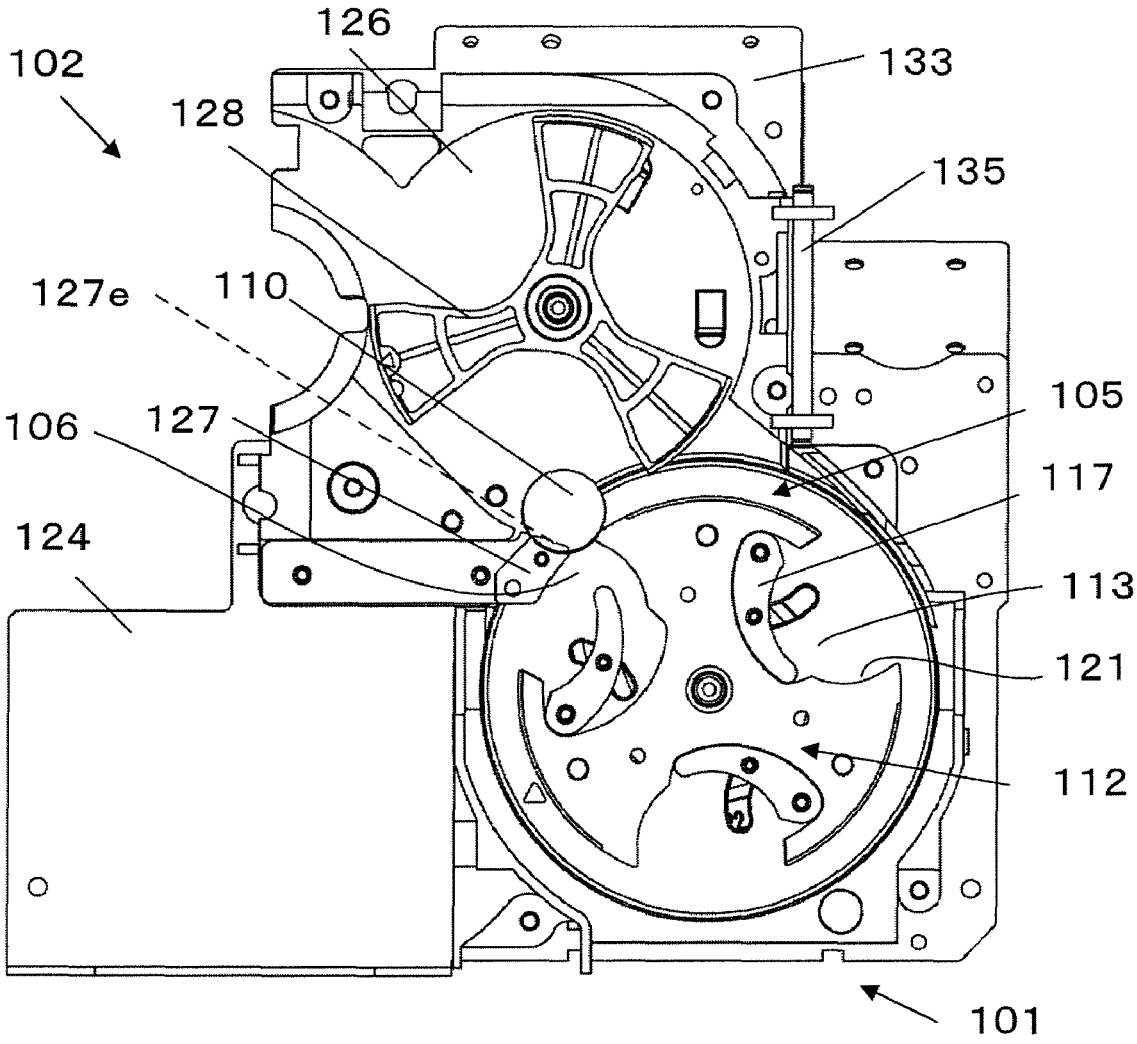
FIG. 13 is a front view showing a coin receiving mistake phenomenon.

As shown in FIG. 13, at the final stage where the coin 110 is put on the coin receiving portion 127 by the moving body 117, the coin may drop off the coin receiving portion 127 or may be held at the tip end 127*e* of the coin receiving portion 127 in a hung manner instead of dropping off completely.

When the coin 110 is not put on the receiving portion 127 and is stopped at the receiving portion 127 in a hung manner, the wheel 128 cannot rotate due to the stopped coin 110 and cannot feed out the coin 110 with its arm 128*a*. Consequently, the wheel 128 cannot rotate, which is determined as an operation failure and will interrupt the operation of the apparatus itself.

Figure 14:
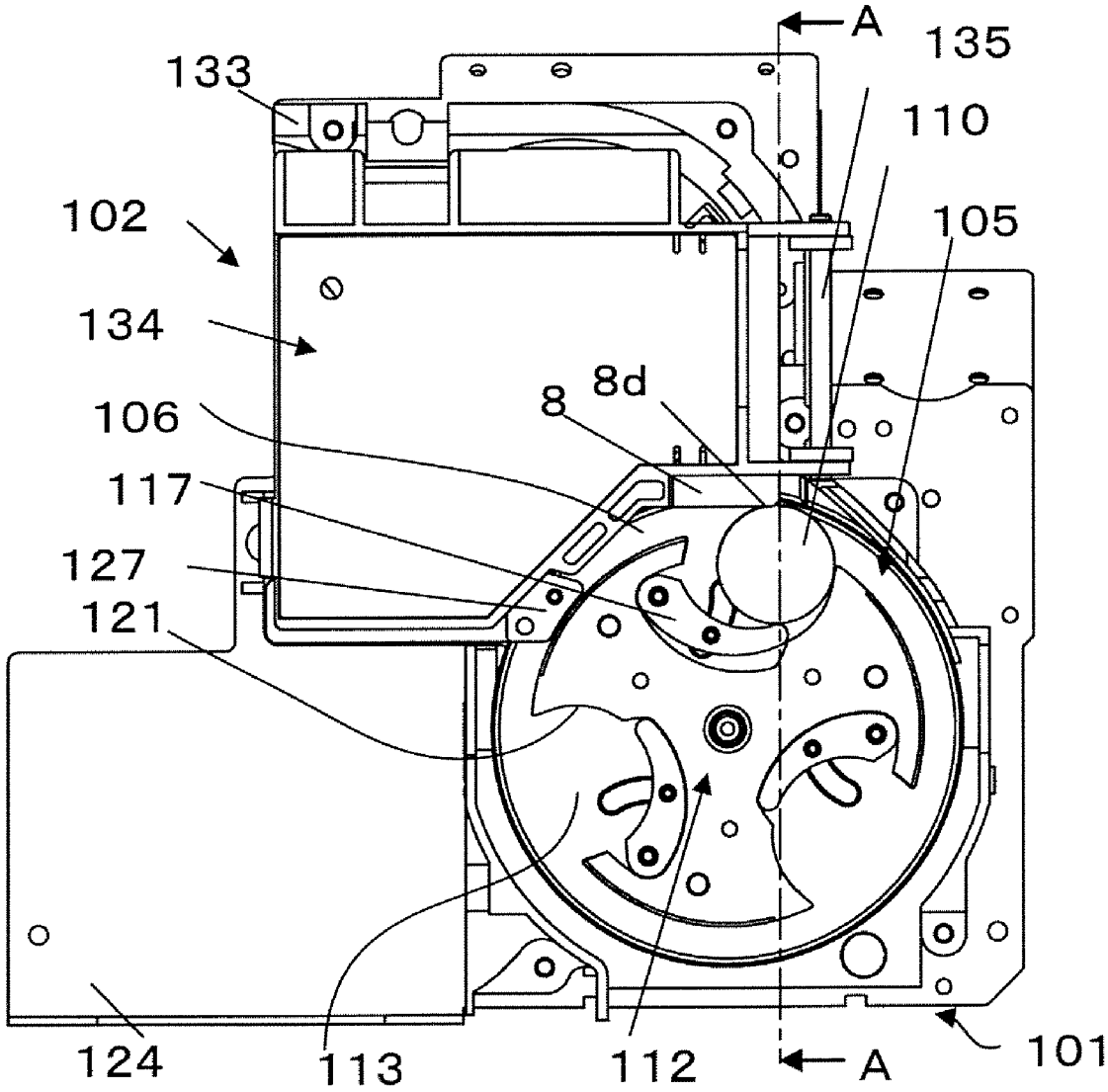
FIG. 14 is a front view showing a coin lock phenomenon.

Moreover, as shown in FIGS. 14 and 15, when the coins 110 are moved from the division recessed portion 113 to the outer periphery by the moving body 117, some coins 110 may jump out from the disk face of the rotation disk 105 due to the apparatus's vibration, and other coins are directed outside of the rotation disk 105 due to momentum. Then, the coins may strike the inlet of the opening 106 like a coin 110B as shown in FIG. 15. In other words, the coin 110B becomes oblique and strikes the tip end 8*d* of the attachment plate 8 at its upper end 110*g* and stops at the opening 106. A coin 110B, stopping at the inlet of the opening 106, is sandwiched and locked between the opening 106 and the moving body 117 and thus cannot move because the coin is pressed at its opposite side with the moving body 117. Because of the thus locked coin 110B, the rotation disk 105 cannot rotate, which causes an abnormal stop to the apparatus.

The repair fixing of an apparatus in an abnormal stop requires removal of the clogged coin 110B or the like, and consequently the working dispensing rate of the coin processing apparatus may significantly decrease.

The present invention addresses these potential problems.

At first, the attachment plate 8 having a horizontally-long plate shape, which extends in a canopy shape as described above, is attached at the lower end of the main body 134 of the coin type determining apparatus 102.

On the other hand, as shown in FIGS. 2 to 10 and the like, the pressing member 10 for elastically pressing the coin 110 against the upper face 105S of the rotation disk 105 is provided along the rotation path near the opening 106 of the rotation disk 105.

The face opposite to the pressing face, that is the lower face of the coin 110, is pushed against the upper face 105S of the rotation disk 105 by the pressing member 10 by way of an appropriate pressing force. Thus, the coin 110 stably lies on the upper face of the rotation disk 105. In this manner, since the coin can be placed on the upper face 105S of the rotation disk 105 in a stable posture, the coin 110 can be smoothly fed out.

Figure 3:
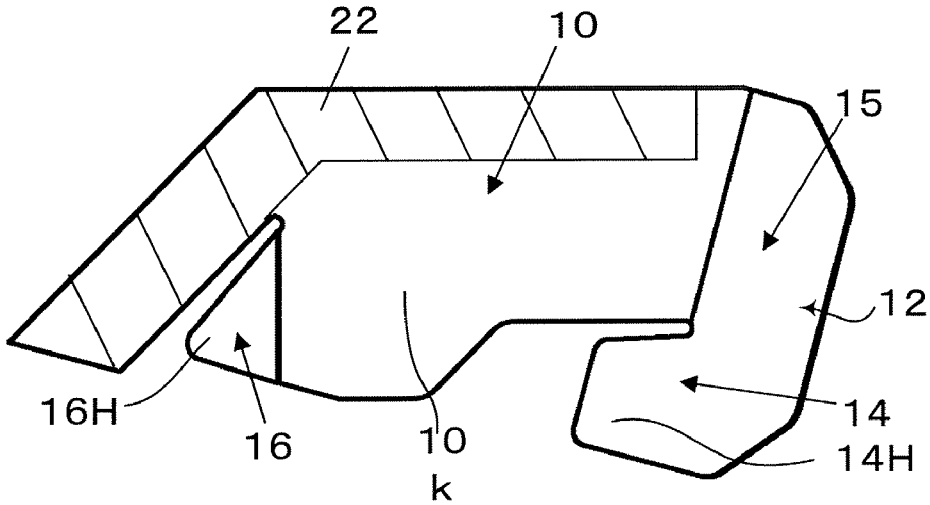
FIG. 3 is a front view of a coin pressing member provided in the coin feeding apparatus according to the present invention.
Figure 4:
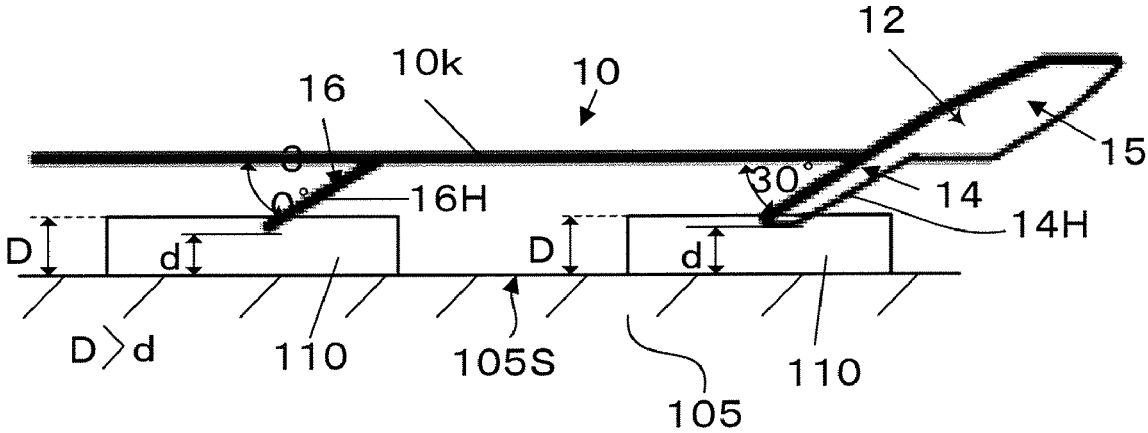
FIG. 4 is a side view of the pressing member.

The pressing member 10 is a flexibly elastic plate which is configured to be made of synthetic resin or the like to have a plane shape as shown in FIG. 3 and to have an oblique portion 12 as shown in FIG. 4 at its upstream part.

The pressing member 10 can be mounted on the rear side of the attachment plate 8 by glue or other adhesive material. The glued portion is illustrated by diagonal lines 22 in FIG. 3. The pressing member 10 can be made of a synthetic resin such as a polycarbonate material having the thickness of about 0.3 mm. Since the pressing member 10 is made of a flexible material such as synthetic resin, the material itself has appropriate elasticity to provide a resilient force.

With more detailed description, the pressing member 10 has a plate-shaped base or body member 10*k* having a predetermined width and length, and the aforementioned oblique portion 12 is integrally formed with the plate-shaped base 10*k* at its upstream one end at a predetermined inclination angle, for example at the inclination angle of 30°. The oblique portion 12 has a first pressing portion 14 which extends downward from the base 10*k*. The first pressing portion 14 is a first elastic pressing piece 14H.

Further, the oblique portion 12 is formed with a block plate 15 (described later) which is continuous with the first pressing portion 14 in the plane and extends upward from the base 10*k*. The block plate 15 is directed for preventing the coin 110 from proceeding toward the opening 106, which will be described later.

The pressing member 10 includes a second pressing portion 16 provided at the other end at a predetermined inclination angle, for example at the inclination angle of 30°. The second pressing portion 16 is a second elastic pressing piece 16H.

The first elastic pressing piece 14H is configured to elastically contact with the upper face of the coin 110 at its tip end as shown in FIG. 4. In other words, as illustrated in the figures, the first elastic pressing piece 14H is provided above the upper face 105S of the rotation disk 105 at the attachment height d such that the tip end thereof is slightly lower than the thickness D of the coin.

Similarly, the second elastic pressing piece 16H is also provided above the upper face 105S of the rotation disk 105 at the attachment height d such that the tip end thereof is slightly lower than the thickness D of the coin. In this case, since several types of coins are treated, the attachment height d is set at a position lower than the thickness D of the thinnest coin.

Since the pressing member 10 is provided such that the first and second elastic pressing pieces 14H and 16 are positioned under such a condition, each elastic pressing piece 14H, 16H presses the coin 110 against the upper face 105S of the rotation disk 105 by a predetermined resilient force according to the amount of deflection of the tip end deflected by the coin, respectively.

The pressing member 10 is configured such that the first pressing portion 14 (first elastic pressing piece 14H) is positioned before the opening 106, the second pressing portion 16 (second elastic pressing piece 16H) is positioned behind the opening 106, and the first and second pressing portions 14, 16 contact with the coin 110 moved by the moving body 117 at an appropriate timing.

Figure 5:
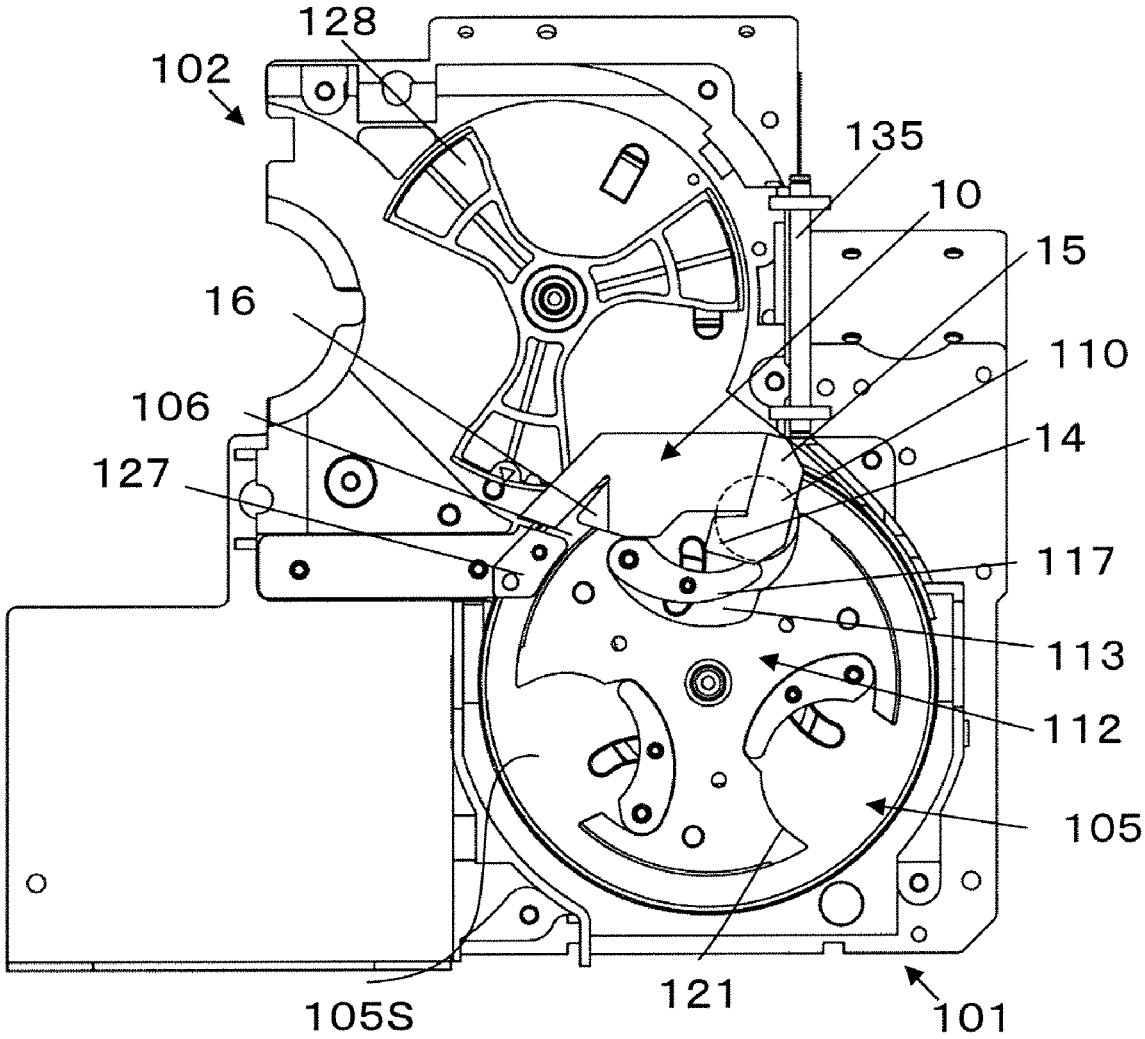
FIG. 5 is a front view showing how coin drop-off is eliminated by the coin feeding apparatus according to the embodiment of the present invention.
Figure 6:
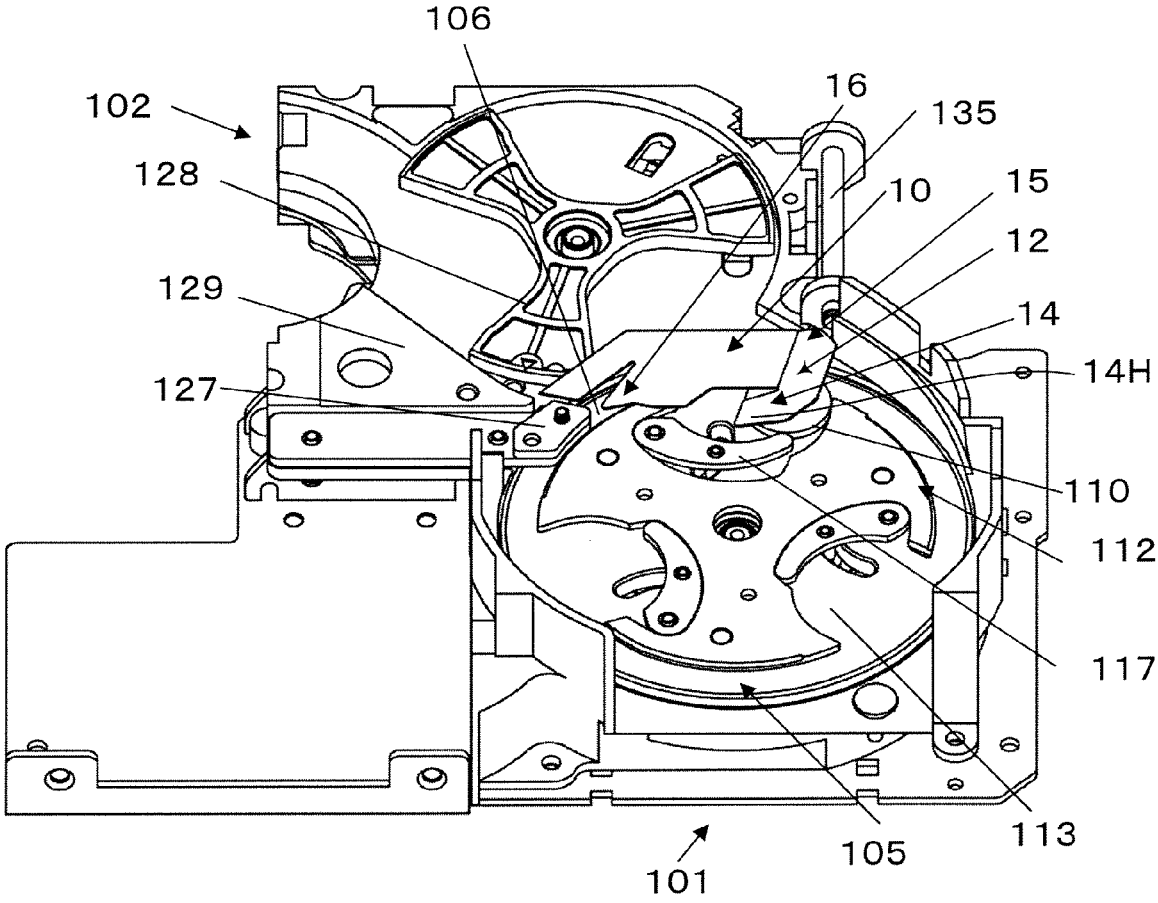
FIG. 6 is a perspective view of an appearance thereof.

Thus, when the coin 110 is moved to the outer periphery side by the moving body 117, the first elastic pressing piece 14H of the pressing member 10 contacts with the coin 110 put on the tip end of the moving body 117 at a position shown in FIGS. 5 and 6 and presses the coin downward. Therefore, the coin 110 can stably lie on the upper face 105S of the rotation disk 105 so that the coin 110 can be smoothly moved by the moving body 117.

In other words, since the coin 110 can be stably pressed so as not to separate from the upper face 105S of the rotation disk 105, the coin 110 is prevented from unstably moving in the thickness direction of the moving body 117 and is held in its appropriate path of movement. Until the final stage where the moving body 117 pivotally operates and pushes the coin 110 from the division recessed portion 113, the coin 110 can be held without dropping off the moving body 117, thereby accurately feeding the coin 110. Thus, the coin feeding rate is improved.

The pressing force by the pressing member 10 can be changed depending on the selection of a material of the pressing member 10, the inclination angle of the elastic pressing pieces 14H, 16H and the providing height, and it is possible to obtain an appropriate pressing force as needed by setting such conditions or parameters. In the embodiment, both the first elastic pressing piece 14H and the second elastic pressing piece 16H are set at the inclination angle of 30°, but may be at a different angle.

A portion where the first pressing portion 14 presses against the coin 110 is at the lower half of the coin face from the center of the coin 110 where a centrifugal force has less impact. This is because it is expected that if the upper half of the coin face at a farther position on the outer periphery from the rotation center of the rotation disk 105 is pressed, the pressing force against the coin may be unstable due to the centrifugal force so that the moving body cannot stably hold the coin.

When the coin 110 is farther carried and approaches the opening 106, the second pressing portion 16 of the pressing member 10 operates. This operation will be described below.

The second pressing portion 16 is a triangle plate-shaped portion which is bent to be inclined downward toward the upper face 105S of the rotation disk 105 at a position opposite to the first pressing portion 12. The second elastic pressing piece 16H, as this bending portion, presses the coin 110 downward, that is toward the upper face 105S of the rotation disk. The second pressing portion 16 is positioned opposite to the coin receiving portion 127 as shown in FIGS. 7 and 8.

Figure 7:
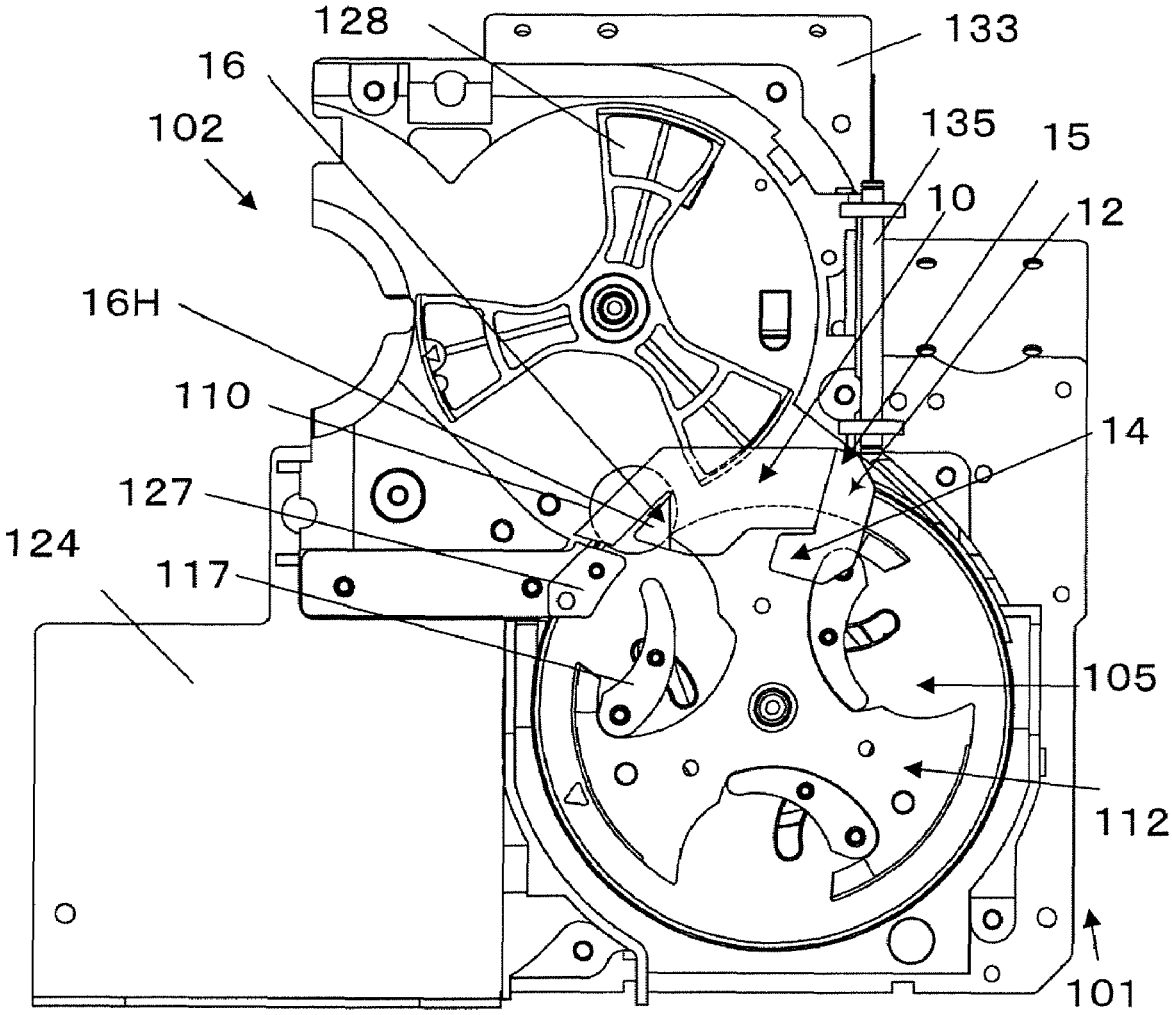
FIG. 7 is a front view showing how a coin receiving mistake is eliminated by the coin feeding apparatus according to the embodiment of the present invention.
Figure 8:
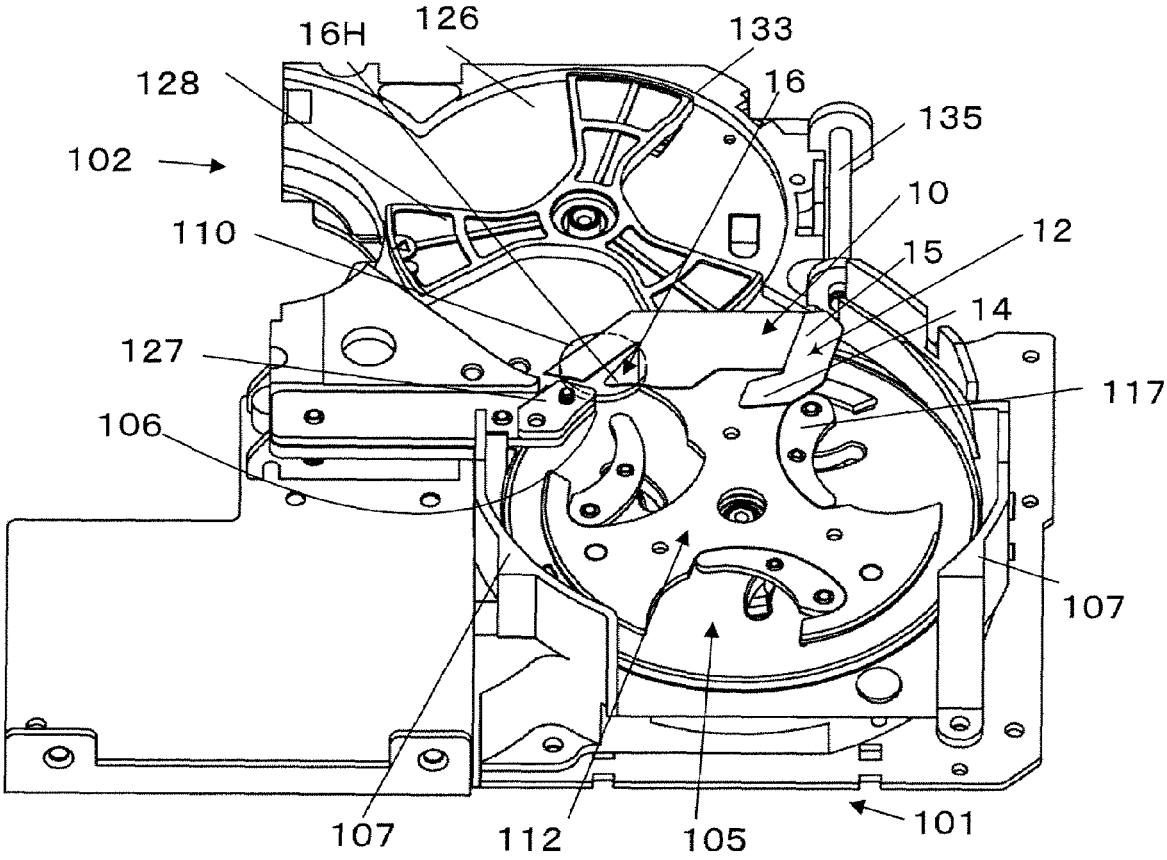
FIG. 8 is a perspective view of an appearance thereof.
Figure 9:
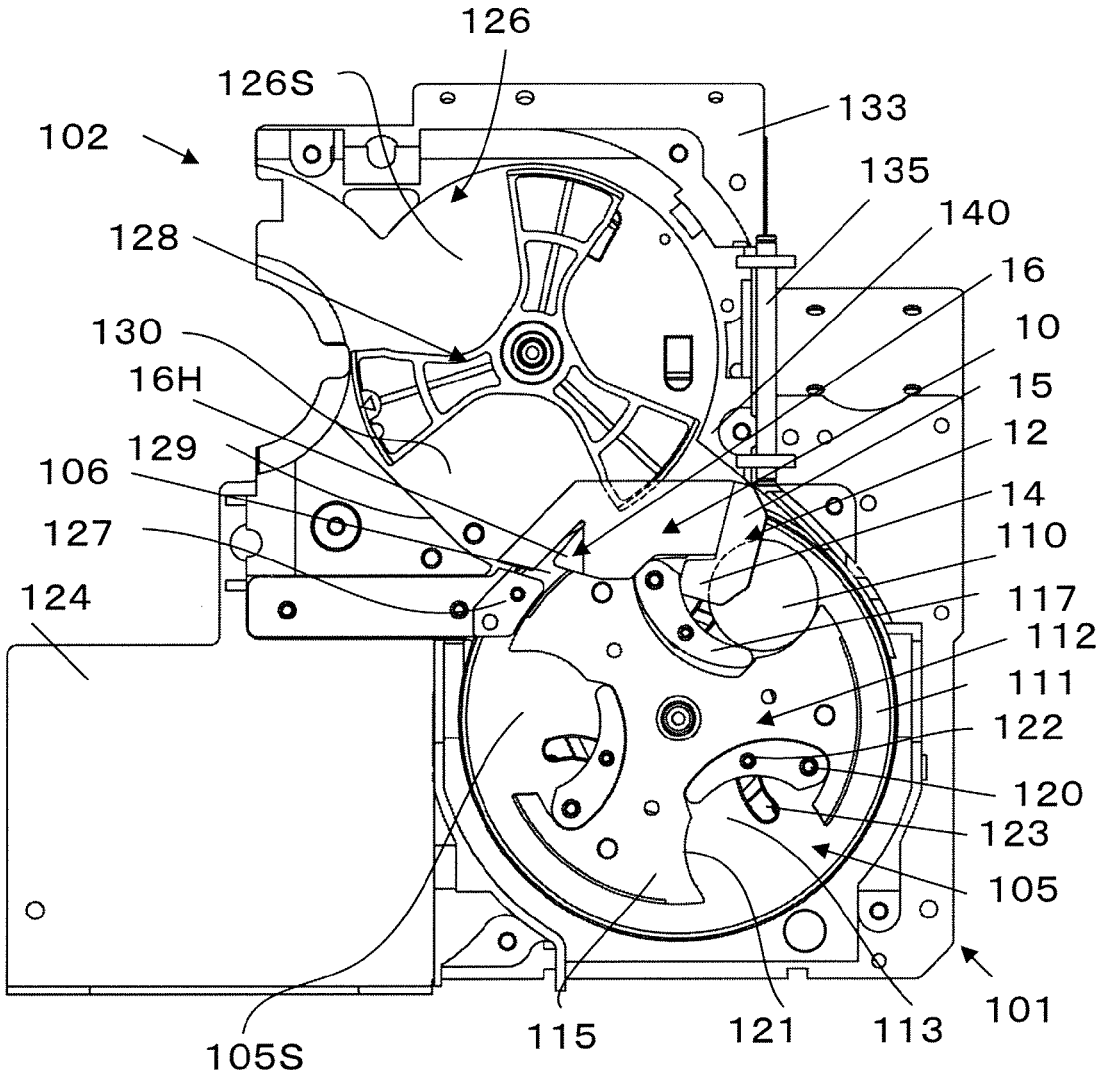
FIG. 9 is a front view showing how coin strike against an opening is eliminated by the coin feeding apparatus according to the embodiment of the present invention.
Figure 10:
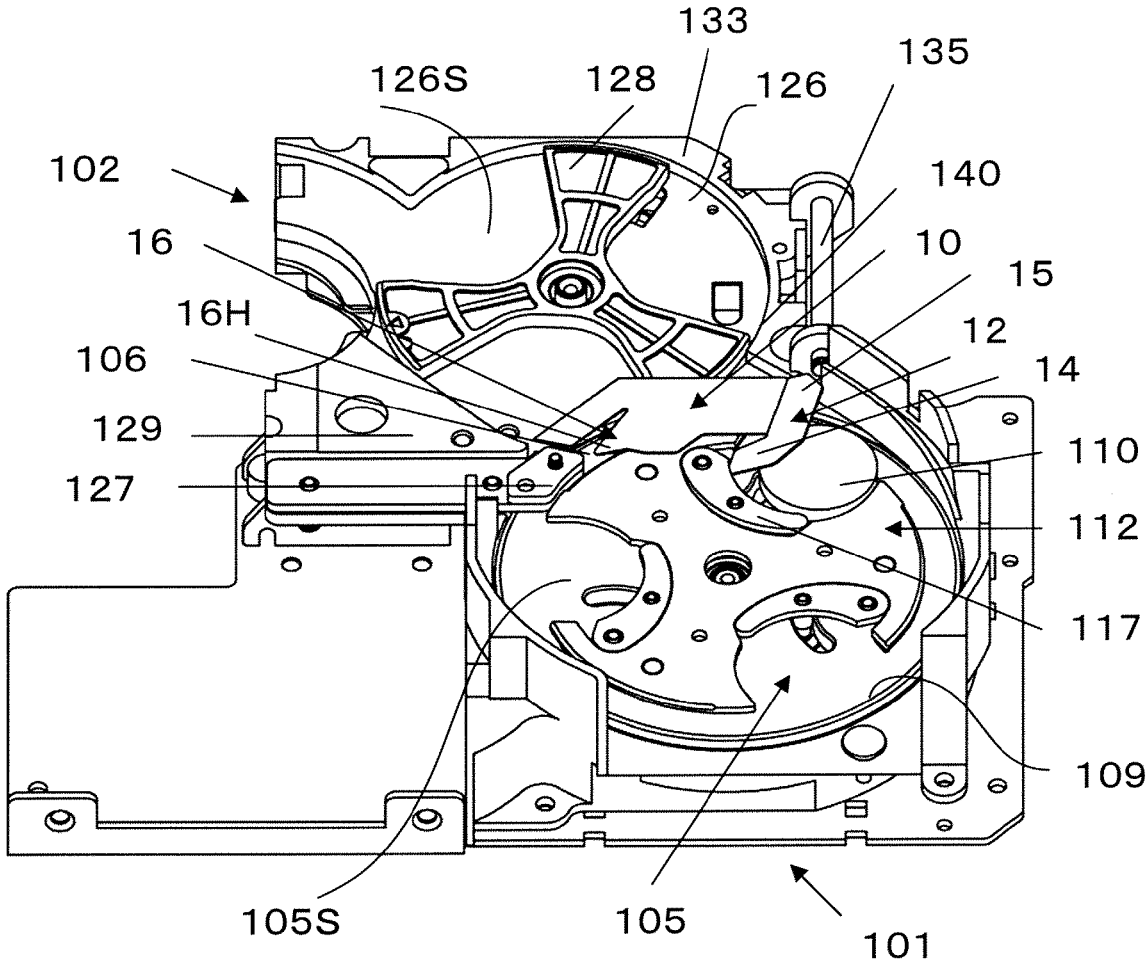
FIG. 10 is a perspective view of an appearance thereof.

Therefore, when the rotation disk 105 rotates and the coin 110 is put on the coin receiving portion 127 by a pivot operation of the moving body 117, the coin 110 is pressed against the upper face 105S of the rotation disk by an appropriate pressure by the second elastic pressing piece 16H of the second pressing portion 16 at a location as shown in FIGS. 7 and 8. Thus, the coin 110 can be stably received at the coin receiving portion 127 and remains placed on the coin receiving portion 127. Thus, the coin will not drop off the coin receiving portion 127.

The coin 110 put on the coin receiving portion 127 can be smoothly fed into the coin type determining apparatus 102 by the arm 128*a* of the wheel 128 which rotates and reaches the position. If there was no pressing member for making the coin receiving state stable, the coin may drop off the coin receiving portion or may be hung in the dropped state.

When the coin stops on the way in the coin receiving portion 127 instead of dropping off completely, the wheel 128 may be stopped due to the coin and cannot rotate, and consequently the apparatus is in abnormal stop condition. However, since the coin 110 is passed to the coin receiving portion 127 in a more stable posture by the second pressing portion 16, the coin 110 will not stop at the coin receiving portion 127 in a hung manner so that the above failures are eliminated.

There will now be a description of the block plate 15, which is provided in the oblique portion 14 of the pressing member 10 and is inclined upward integrally with the first elastic pressing piece 14H.

The block plate 15 is an elastic plate inclined upward relative to the upper face 105S of the rotation disk 105 toward the upstream side of the rotation direction of the rotation disk 105 and is formed continuously with the first pressing portion 12 as shown in FIGS. 3, 4, 5 and FIGS. 9, 10. The inclination angle of the block plate 15 is 30°, which is the same as the first elastic pressing piece 14H. The block plate 15 has a necessary width, which extends for a predetermined length in the diameter direction of the rotation disk 105, and thus extends near the opening 106.

Therefore, when the block plate 15 covers the rotation disk 105 like a roof before the opening 106, even when a coin 110 proceeds toward the inlet of the opening 106, the block plate 15 prevents it. Thus, the coin 110 is prevented from striking the opening 106 as disclosed with a conventional coin 110B in FIG. 15.

Since the block plate 15 forms a barrier and is provided in an upward-inclined manner relative to the upper face 105S of the rotation disk 105, even if the coin may jump from the disk face 105S due to the apparatus's vibration, the coin is still restricted from jumping by the block plate 15 and is prevented from falling out of the desired coin path, and consequently will not strike the opening 106.

Since the pressing member 10 is made of a flexible member such as a synthetic resin, it has an elastic force and operates to return the coin 110 toward the upper face 105S of the disk by an appropriate pressure even when the coin 110 bounces and strikes the block plate 15 so that the blocking function on the coin works well. The pressing member 10 can be integrally molded as a one piece member with appropriately hinged first and second pressing pieces 14 and 16.

In this manner, there will not occur a lock state in which a coin striking the opening 106 causes the coin 110B to be sandwiched between the inlet of the opening 106 and the moving body 117, which was a conventional problem as shown in FIGS. 14 and 15. Thus, since a failure such as rotation stop of the rotation disk 105 is eliminated, the coin can be smoothly fed into the coin type determining apparatus at the next step, thereby obtaining the coin feeding apparatus capable of efficiently processing the coins.

The present invention can easily and accurately eliminate failures such as the lock phenomenon at the coin feeding port, the coin dropping-off phenomenon from the moving body, the rotation disability of the rotation disk due to coin stop at the coin receiving portion and the like by providing the coin pressing member 10 described above.

Thus, since the coin feeding operation of the coins can be stably performed, the coin processing rate of the entire apparatus is remarkably improved, thereby obtaining a beneficial coin feeding apparatus.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. In coin feeding apparatus configured such that after coins are held in a division recessed portion arranged on an upper face of a rotation disk, the coins are fed out from an opening provided at a predetermined position in the periphery direction of the rotation disk by a coin pushing moving body movably provided in the division recessed portions, the improvement comprising:

when the coins are moved in a periphery direction of the rotation disk by the moving body at the time of the rotation of the rotation disk, a pressing member is provided for elastically pressing the coins downward against the upper face of the rotation disk, wherein the pressing member is provided with a first pressing portion for elastically pressing coins moved from the division recessed portion in the periphery direction of the rotation disk by the moving body against the upper face of the rotation disk adjacent the opening and a second pressing portion for pressing the coins immediately before being passed by the moving body to a coin receiving portion provided near the opening against the upper face of the rotation disk.

2. The coin feeding apparatus according to claim 1, further comprising a block plate inclined upward relative to the upper face of the rotation disk toward the rotation upstream direction of the rotation disk, for preventing the coins moved in the periphery direction of the rotation disk from proceeding toward the inlet of the opening, which is provided continuously with the first pressing portion and extends in the diameter direction of the rotation disk.

3. The coin feeding apparatus according to claim 2, wherein the pressing member is an elastic pressing plate integrally composed of a first elastic pressing piece which is inclined downward and extends so as to be positioned before the opening and dimensional to contact with the coins on the rotation disk at its tip end and a second elastic pressing piece which is inclined downward and extends so as to be positioned behind the opening and dimensional to contact with the coins on the rotation disk at its tip end.

4. A pressing member for mounting on a coin feeding apparatus to control the translation of coins on a rotary disk, comprising:

a body member having a relatively movable first pressing portion of a configuration to extend for contact with a coin to exert a downward force when mounted above a rotary disk, wherein the body member includes a relatively movable second pressing portion, separate from the first pressing portion, of a configuration to extend for contact with the coin after the coin has contacted the first pressing portion to exert a downward force on the coin.

5. The pressing member of claim 4 wherein the body member of the second pressing portion has a triangular configuration with a tip portion contacting the coin.

6. The pressing member of claim 4 wherein the body member further includes a block plate adjacent the first pressing portion that extends upward from the body member relative to the first pressing portion to prevent a release of the coin from the rotary disk.

7. The pressing member of claim 6 wherein the block plate connects the first pressing portion to the body member.

8. The pressing member of claim 4 wherein the pressing member is integrally formed of a resin material.

9. The pressing member of claim 4 wherein the first pressing member and the second pressing member are orientated at a 30° angle to a plane containing the body member surface.

10. The pressing member of claim 4 further including a perimeter L-shape attachment surface of the body member with an adhesive coating.

11. A method of releasing coins from a coin feeding apparatus having a rotary disk selector for receiving individual coins from a storage bowl and dispensing the coins at a release opening to a coin type determining apparatus, comprising the steps of:

exerting, adjacent the release opening, a first resilient force by a first pressing piece to press the coin against a surface of the supporting rotary disk selector, and exerting a second resilient force to push the coin downward against the rotary disk, by a second pressing piece, the first resilient force is released from the coin immediately adjacent the release opening.

12. The method of claim 11 further comprising the step of providing a block plate that is positioned adjacent and upstream of the first resilient force to direct any coin that raises from the rotary disk selector at a location of the first resilient force.

13. The method of claim 12 further comprising the step of providing a plastic press member above the rotary disk selector with a first downwardly inclined plate and a second downwardly inclined plate to enable the first resilient force with the first downward plate to extend into the translation path of the coin and the second resilient force with a second downward plate extend into the translation path of the coin, upstream of the first downward plate.

14. In coin feeding apparatus configured to dispense coins of different sizes such that after coins are held on a first bottom face in a division recessed portion arranged on an upper face of a rotation disk, that can dynamically vary the size of the recessed portion to accommodate different sized coins as received, the coins are fed out from an opening provided at a predetermined position in a periphery direction of the rotation disk by a coin pushing moving body movably provided in the division recessed portions, to a coin type determining apparatus with the coins held on a second bottom face of the coin type determining apparatus, the improvement comprising:

when the coins are moved in the periphery direction of the rotation disk by the moving body at the time of the rotation of the rotation disk, a pressing member is provided adjacent the opening at the periphery of the rotation disk to elastically press the coins downward against the first bottom face as it approaches the opening and afterwards to elastically press the coin downward for translation to the second bottom face as the coin is released from the opening, wherein a positive locational control of the coin is maintained in the translation from the rotational disk to the coin type determining apparatus.

* * * * *